US007814856B1

(12) United States Patent
Smith et al.

(10) Patent No.: US 7,814,856 B1
(45) Date of Patent: Oct. 19, 2010

(54) DEEP WATER OPERATIONS SYSTEM WITH SUBMERSIBLE VESSEL

(75) Inventors: Dave Smith, Jacksonville, FL (US); Guy Heyl, Lakeland, FL (US); Ronald E. Smith, Friendswood, TX (US); Julian G. Angus, Sarasota, FL (US); Charles M. Staehle, Palm Beach Gardens, FL (US)

(73) Assignee: Down Deep & Up, LLC, Sarasota, FL (US)

( * ) Notice: Subject to any disclaimer, the term of this patent is extended or adjusted under 35 U.S.C. 154(b) by 0 days.

(21) Appl. No.: 12/626,357

(22) Filed: Nov. 25, 2009

(51) Int. Cl.
*B63G 8/00* (2006.01)

(52) U.S. Cl. ..... 114/328; 114/313

(58) Field of Classification Search ..... 114/312, 114/313, 321, 322, 325–328; 405/185, 188–191
See application file for complete search history.

(56) References Cited

U.S. PATENT DOCUMENTS

| | | | | |
|---|---|---|---|---|
| 1,225,662 | A * | 5/1917 | Lee | 114/322 |
| RE28,978 | E | 9/1976 | Brooks | |
| 4,014,180 | A | 3/1977 | Kelly et al. | |
| 4,030,216 | A | 6/1977 | Willums | |
| 4,052,703 | A | 10/1977 | Collins, Sr. et al. | |
| 4,075,862 | A | 2/1978 | Ames | |
| 4,484,838 | A * | 11/1984 | Stevens | 405/191 |
| 4,721,055 | A | 1/1988 | Pado | |
| 4,784,525 | A | 11/1988 | Francois | |
| 6,349,665 | B1 | 2/2002 | Taylor, Jr. | |
| 6,588,985 | B1 | 7/2003 | Bernard | |
| 7,209,288 | B2 * | 4/2007 | Wantig et al. | 359/402 |
| 7,246,566 | B2 | 7/2007 | Marion | |
| 2002/0040782 | A1 | 4/2002 | Rytlewski et al. | |
| 2004/0194963 | A1 | 10/2004 | Torres | |
| 2004/0218981 | A1 | 11/2004 | Chenin | |
| 2005/0016735 | A1 | 1/2005 | Ireland et al. | |
| 2005/0276665 | A1 | 12/2005 | Entralgo et al. | |
| 2006/0159524 | A1 | 7/2006 | Thompson et al. | |
| 2007/0107905 | A1 | 5/2007 | Bhat et al. | |
| 2007/0196180 | A1 | 8/2007 | Haughom | |
| 2007/0258774 | A1 | 11/2007 | Thompson et al. | |
| 2008/0210432 | A1 | 9/2008 | Crossley et al. | |
| 2008/0230228 | A1 | 9/2008 | Askeland | |
| 2009/0052992 | A1 | 2/2009 | Thompson et al. | |
| 2009/0056936 | A1 | 3/2009 | McCoy, Jr. | |

* cited by examiner

*Primary Examiner*—Ed Swinehart
(74) *Attorney, Agent, or Firm*—Charles J. Prescott

(57) ABSTRACT

A deep water operations system includes a submersible vessel including a propulsion system for operating the vessel on and beneath the surface of a body of water. The vessel will operate on the water surface to travel to a designated site and then submerge beneath the surface to a depth sufficient to avoid surface wave and weather conditions. A surface power buoy is deployable from the vessel at the water surface and connected to the vessel by an umbilical cord and includes a propulsion system, RF vessel communication and a GPS receiver. An ROV launch cage is supported by the vessel by a second umbilical cord and stores and deploys an ROV remotely controlled from the vessel for deep water work and repair activities via the second umbilical cord.

2 Claims, 9 Drawing Sheets

DEEP WATER OPERATIONS SYSTEM WITH SUBMERSIBLE VESSEL

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the use of remotely operated vehicles (ROV) in conjunction with systems and apparatus for underwater work activity, and more particularly to a system incorporating a submersible vessel and an ROV for deep sea bottom work and repair activity particularly associated with oil and gas well conduit resting on the sea bottom, the vessel also referred to herein as "Sub-Cat".

2. Description of Related Art

A number of systems and apparatus have been developed for shallow and deep water work and repair activity required to install, maintain and repair deep water equipment such as oil and gas well fields.

U.S. Pat. No. 4,052,703 to Collins, Sr., et al. discloses a sub sea well installation having means for performing control functions by electrical command signals transmitted over a primary cable from a remote surface location. An apparatus and method of transferring seismic equipment to and from an operations platform and an underwater location are disclosed by Thompson et al. in U.S. Publication 2009/0052992.

Thompson also teaches a method and apparatus to deploy and retrieve ocean bottom seismometer systems in deep marine environments in U.S. Publication 2007/0258774. An apparatus for use in servicing a submerged unit is disclosed in U.S. Pat. No. 4,784,525 to Francois.

Entralgo et al. teach a remotely operated system and method for deployment of cables and other lines sub sea in U.S. Publication No. 2005/0276665. A sub sea well workover system and method are taught by Torres in U.S. Publication 2004/0194963.

U.S. Patent Re. 28,978 to Brooks discloses a sub sea system for the recovery of subaqueous deposits of fluid minerals. Chenin teaches a seafloor-surface connection installation for a submarine pipeline in U.S. Publication 2004/0218981.

Taylor, Jr. teaches a drone vessel for a remote operated vehicle in U.S. Pat. No. 6,349,665. A modular watercraft capable of both surface and submersible accommodation and transport of passengers is taught by Marion in U.S. Pat. No. 7,246,566.

U.S. Pat. No. 4,014,180 to Kelly et al. discloses a method for making a remote controlled sub sea pipe connection. Pado teaches a remotely operated underwater vehicle in U.S. Pat. No. 4,721,055. A method and apparatus for installing underwater flowlines is taught by Ames in U.S. Pat. No. 4,075,862.

Willums teaches a method and apparatus for underwater hydraulic conveying in U.S. Pat. No. 4,030,216. A system and vessel for supporting offshore fields is taught by Crossley et al. in U.S. Publication 2008/0210432.

Haughom discloses a drilling rig placed on the seabed and equipped for drilling of oil and gas wells in U.S. Publication 2007/0196180. Bhat et al. teach a dry tree subsea well communications methods using variable tension large offset risers in U.S. Publication 2007/0107905.

A subsea structure load monitoring and control system is disclosed by McCoy, Jr. in U.S. Publication 2009/0056936. Rytlewski et al. teach a method and system of subsea intervention in U.S. Publication 2002/0040782.

In U.S. Publication 2006/0159524, Thompson et al. disclose a method and apparatus for deployment of ocean bottom seismometers. A remotely operated vehicle retrievable sea floor pump is taught by Ireland et al. in U.S. Publication 2005/0016735.

Askeland discloses a system and method for well intervention in U.S. Publication 2008/0230228. U.S. Pat. No. 6,588,985 to Bernard discloses an apparatus and method for deploying an object or a load on a seabed.

Weather conditions at the surface of the water can also have an impact upon the ability to implement work and repair activity. Moreover, travel to the work site area may require substantial amounts of fuel and time to transport the primary support vehicle which, if of sufficient size to withstand the rigors of heavy seas from severe weather conditions, will also demand more travel time and fuel consumption.

The present invention provides a system which includes a primary vessel capable of high speed travel to arrive at a work site area quickly and which carries an ROV launch cage capable of being submerged to great depths before the ROV it carries is deployed from the launch cage. Should heavy seas or severe weather conditions be present at the work site, the vessel is capable of being submerged to shallow water depths sufficient to be relatively unaffected by those sea surface conditions (e.g., up to about 200' depth). However, a surface power buoy in those circumstances is deployable at the surface to maintain radio RF contact with other ships and shore stations and to continue to receive GPS positioning signals which are transmitted via a first umbilical cord to the manned vessel for onsite operations control. By deploying the ROV from the launch cage, the ROV umbilical cord need not be of great length as the launch cage may be deployed to great depths before launch of the ROV to conduct work activities on and near the sea bottom.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a deep water operations system includes a submersible vessel including a propulsion system for operating the vessel on and beneath the surface of a body of water. The vessel will operate on the water surface to travel to a designated site and then submerge beneath the surface to a depth sufficient to avoid surface wave and weather conditions. A surface power buoy is deployable from the vessel at the water surface and connected to the vessel by an umbilical cord and includes a propulsion system, RF vessel communication and a GPS receiver. AN ROV launch cage is supported by the vessel by a second umbilical cord and stores and deploys an ROV remotely controlled from the vessel for deep water work and repair activities via the second umbilical cord.

It is therefore an object of this invention to provide a deep water operations system incorporating an ROV which is deployable at great seawater depth to implement necessary work and repair operations to install and maintain equipment on the sea bottom such as oil and gas pipeline.

Yet another object of this invention is to provide a deep water operations system which includes a submersible vessel for operations control which may be submerged below the surface of the water to a shallow depth to avoid heavy surface sea conditions.

Still another object of this invention is to provide a deep water surface operations system which includes a surface power buoy connected by umbilical cord to the submersible vessel for maintaining radio contact with other ships in the area and for continuously receiving updated GPS satellite signals showing current global positioning of the system while the vessel is submerged.

Another object of this invention is to provide a deep water operations system which deploys an ROV at great sea depth from a protective launch cage which is lowerable by a support umbilical cord from the submerged vessel to near the depth of the sea bottom after which the ROV is deployed therefrom.

Yet another object of this invention to provide a deep water operations system which minimizes surface weather related downtime by the submersion of the Sub-Cat vessel to water depths of up to 200 feet which places the operations vessel well below the effects of surface weather conditions.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
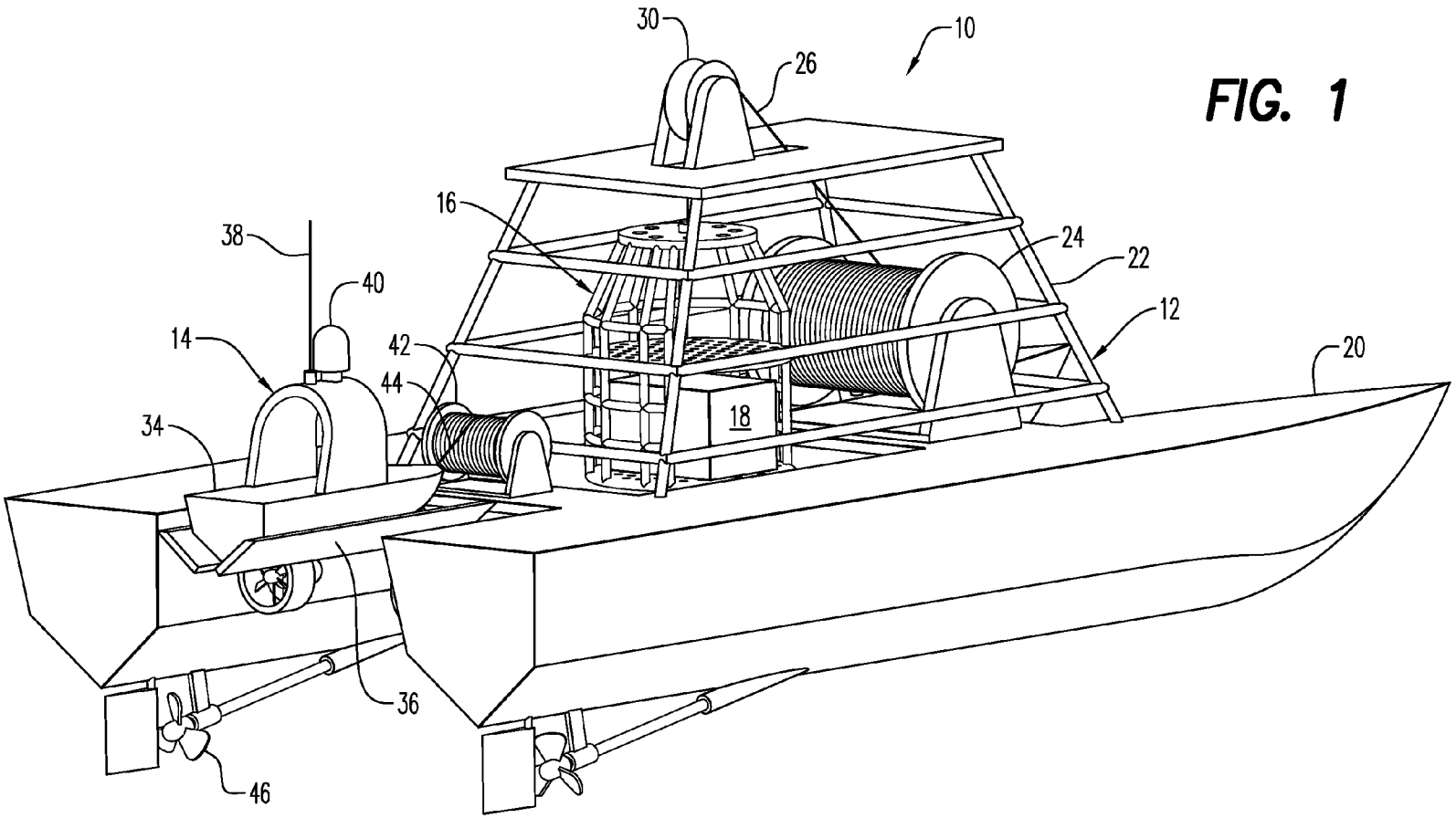
FIG. 1 is a perspective view of the deep water operations system.
Figure 2:
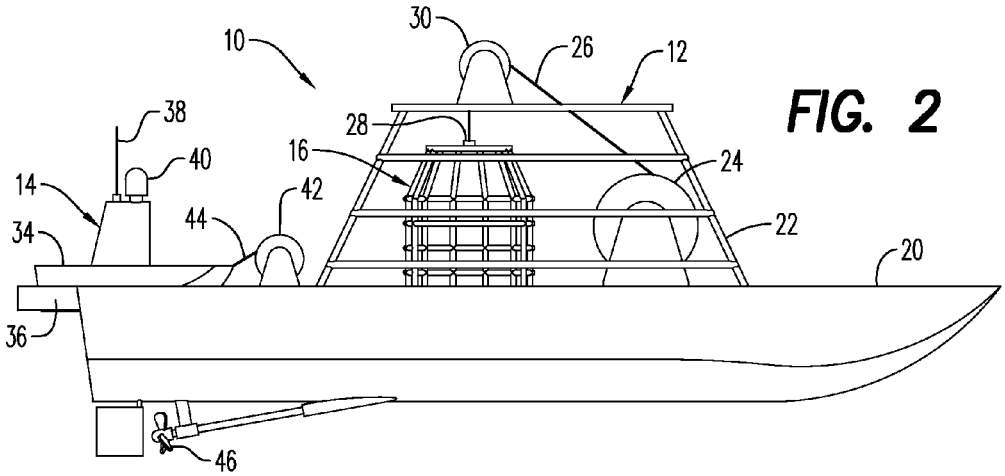
FIG. 2 is a side elevation view of FIG. 1.
Figure 3:
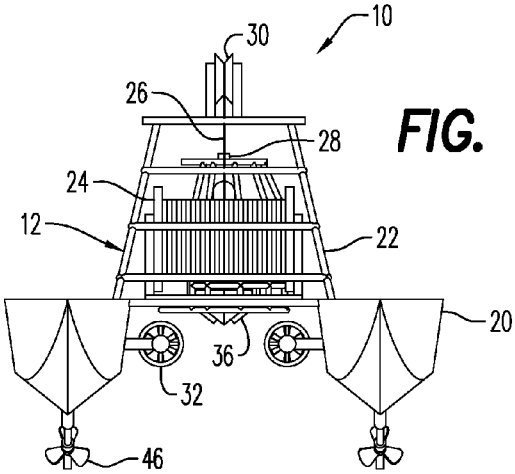
FIG. 3 is a front elevation view of FIG. 1.
Figure 4:
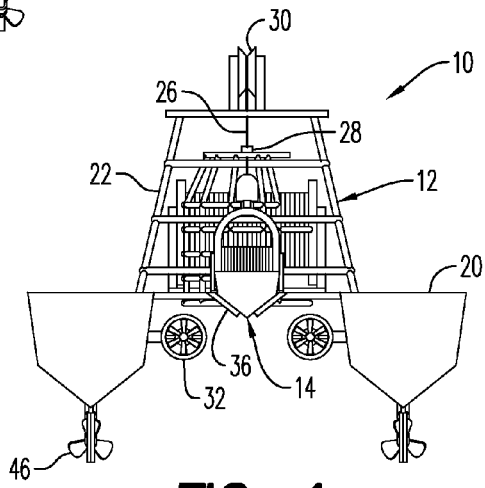
FIG. 4 is a rear elevation view of FIG. 1.
Figure 5:
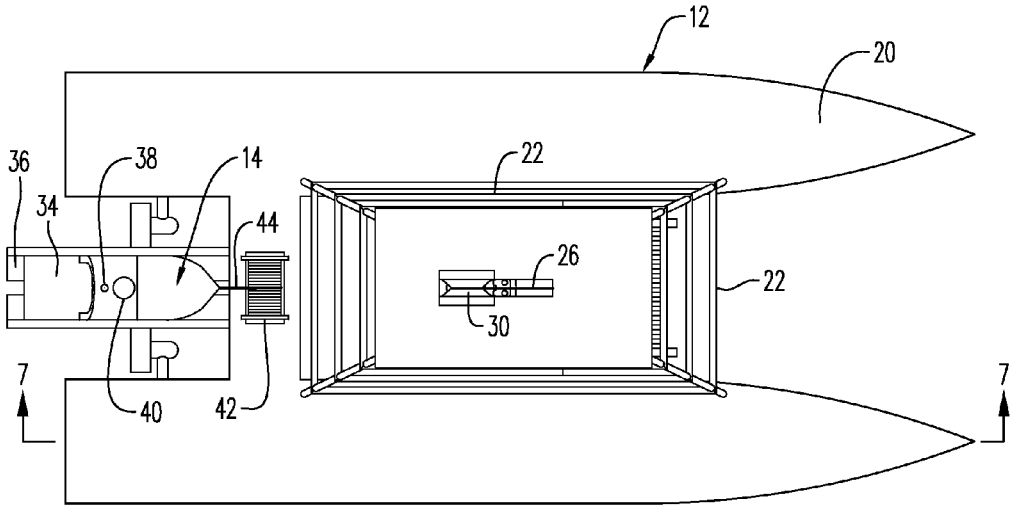
FIG. 5 is top plan view of FIG. 1.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring to the drawings, and firstly to FIGS. 1 to 7, the system is there shown generally at numeral 10 and includes a vessel 12 which is submersible to relatively shallow water depths and is preferably in the form of a catamaran and hereinafter may alternately be referred to as "Sub-Cat". The vessel 12, formed of spaced catamaran hulls 20 which are interconnected by a tubular catamaran superstructure 22 and an open deck, includes dual propulsion systems. An internal combustion engine drives a conventional propeller 46 disposed in each of the catamaran hulls 20. This means of propulsion is utilized for travel of the vessel 12 over the water surface, particularly at great distances and at somewhat higher speeds for time and fuel economy. A second propulsion system includes a caged thruster 32 for each of the catamaran hulls 20, the thrusters 32 being powered by battery power within each of the airtight hulls 20. This propulsion system 32 is utilized to move the vessel 12 when it is submerged below the surface of the water.

The system 10 further includes a surface power buoy 14 which is supported when not in use on a buoy support 36 attached between the stern areas of each of the hulls 20. The power buoy 14 includes a buoy hull 34, an upstanding RF antenna 38 for receiving and transmitting radio frequency communication signals between the vessel 12 and other boats and ships in the area as well as land based RF transmitters. A GPS antenna 40 is also provided with the buoy hull 34 for receiving GPS satellite signals which are transmitted along with RF signals via a first umbilical cord 44 to and from the electronics control station within the hulls 20. When deployed, the power buoy 14, being preferably unpowered, is towed at slow speeds or stationary by the first umbilical cord 44 behind the vessel 12.

Figure 6:
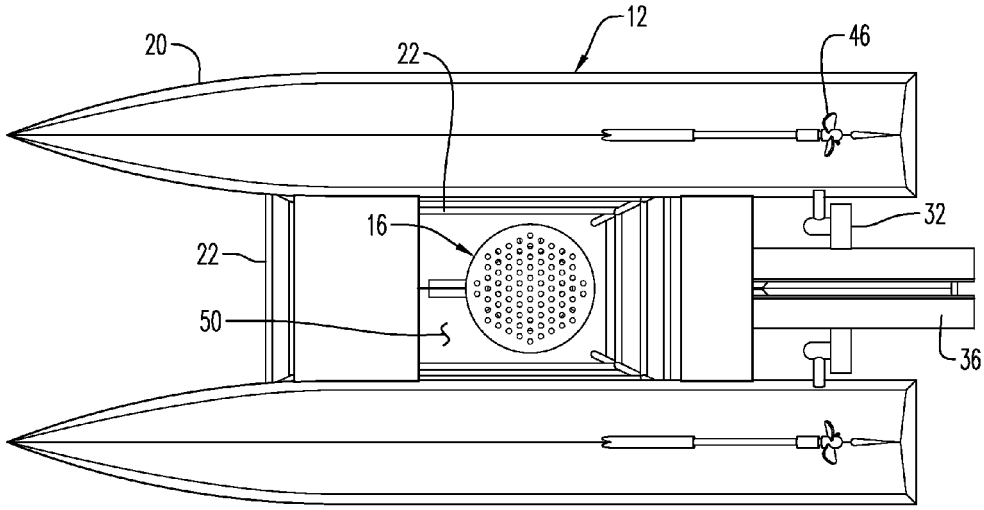
FIG. 6 is a bottom plan view of FIG. 1.

The system 10 further includes an ROV launch cage 16 structured to house and support and to protect an ROV 18 therewithin during surface travel of the vessel 12 and during deep water deployment and retrieval of the ROV 18. The launch cage 12 is supported at lifting ring 28 by one end of a second umbilical cord 26 which is stored on an ROV winch 24 attached to the mid-ship deck area between the catamaran hulls 20. The ROV umbilical cord extends diagonally upwardly from the ROV winch 24 to a pulley 30 mounted atop the catamaran superstructure 22. As best seen in FIG. 6, the deck area includes an ROV cage launch port 50 sized for lowering the launch cage 16 downwardly therethrough as controlled by the ROV winch 24.

Figure 9:
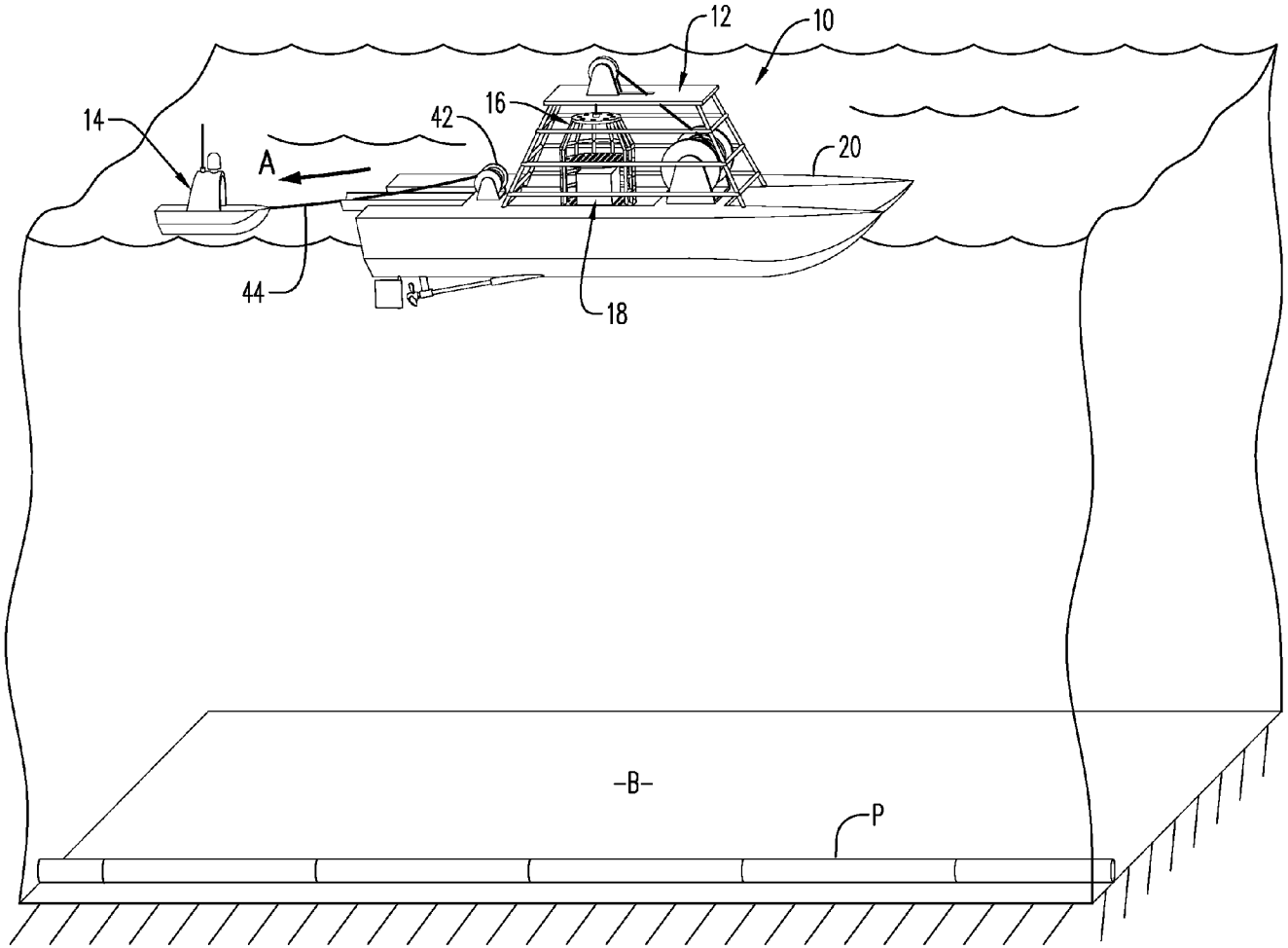
FIGS. 9 to 12 are pictorial views depicting the stages of deployment of the system including the surface launch of the surface power buoy, shallow water submersion of the Sub-Cat vessel, lowering of the ROV launch cage and deployment of the ROV.

Referring now to FIGS. 8 to 12, the Sub-Cat 12 is shown traveling over the surface of the water to a location over a pipeline P work area disposed at the sea bottom B. Having arrived over the designated work site, which may be disposed at a sea bottom B, perhaps several thousand feet below the surface of the water, the power buoy 14 is launched in the direction of arrow A from the buoy support 36 and is held tethered to the Sub-Cat 12 by the umbilical cord 44, the amount of which is controlled by a deck mounted power buoy winch 42 as seen in FIG. 9.

Figure 7:
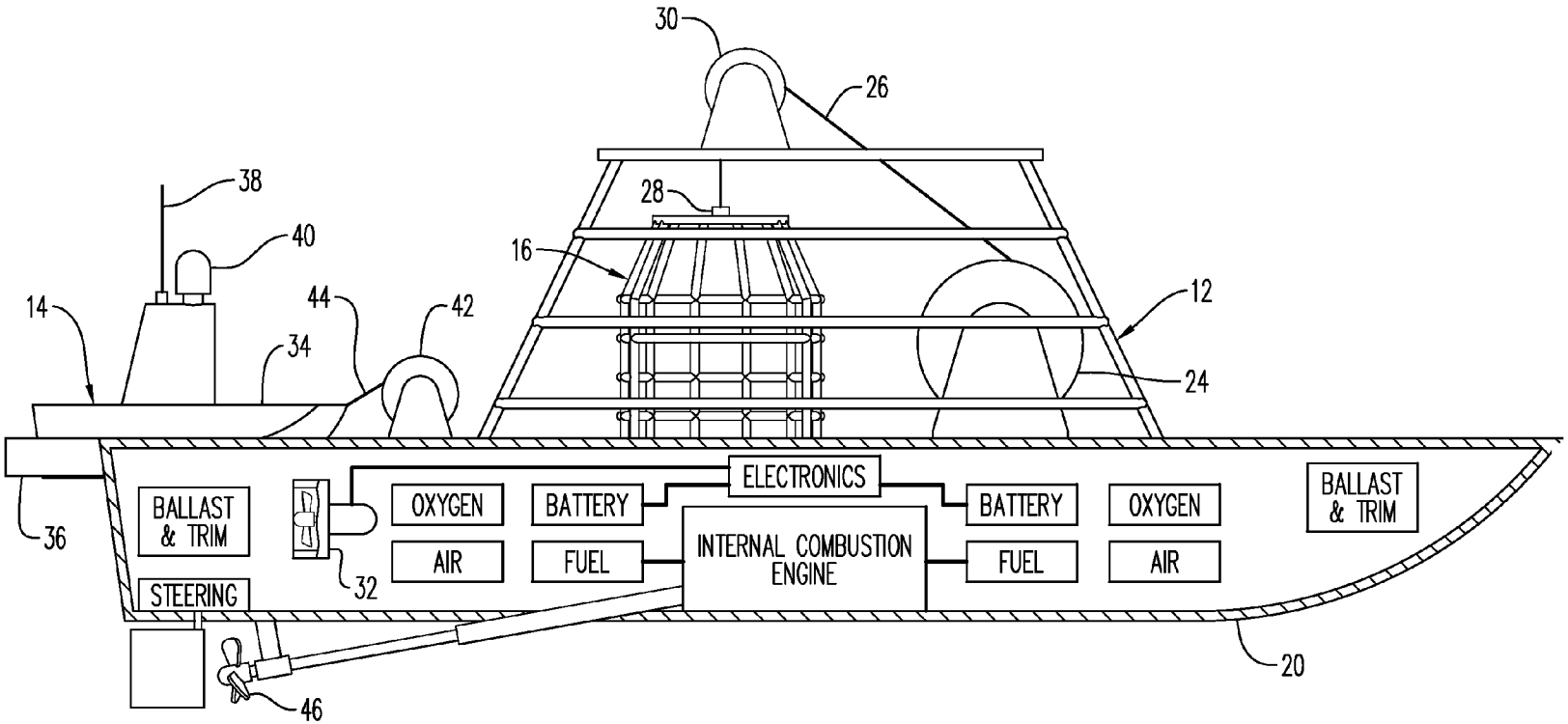
FIG. 7 is a simplified section view in the direction of arrows 7-7 in FIG. 5.
Figure 8:
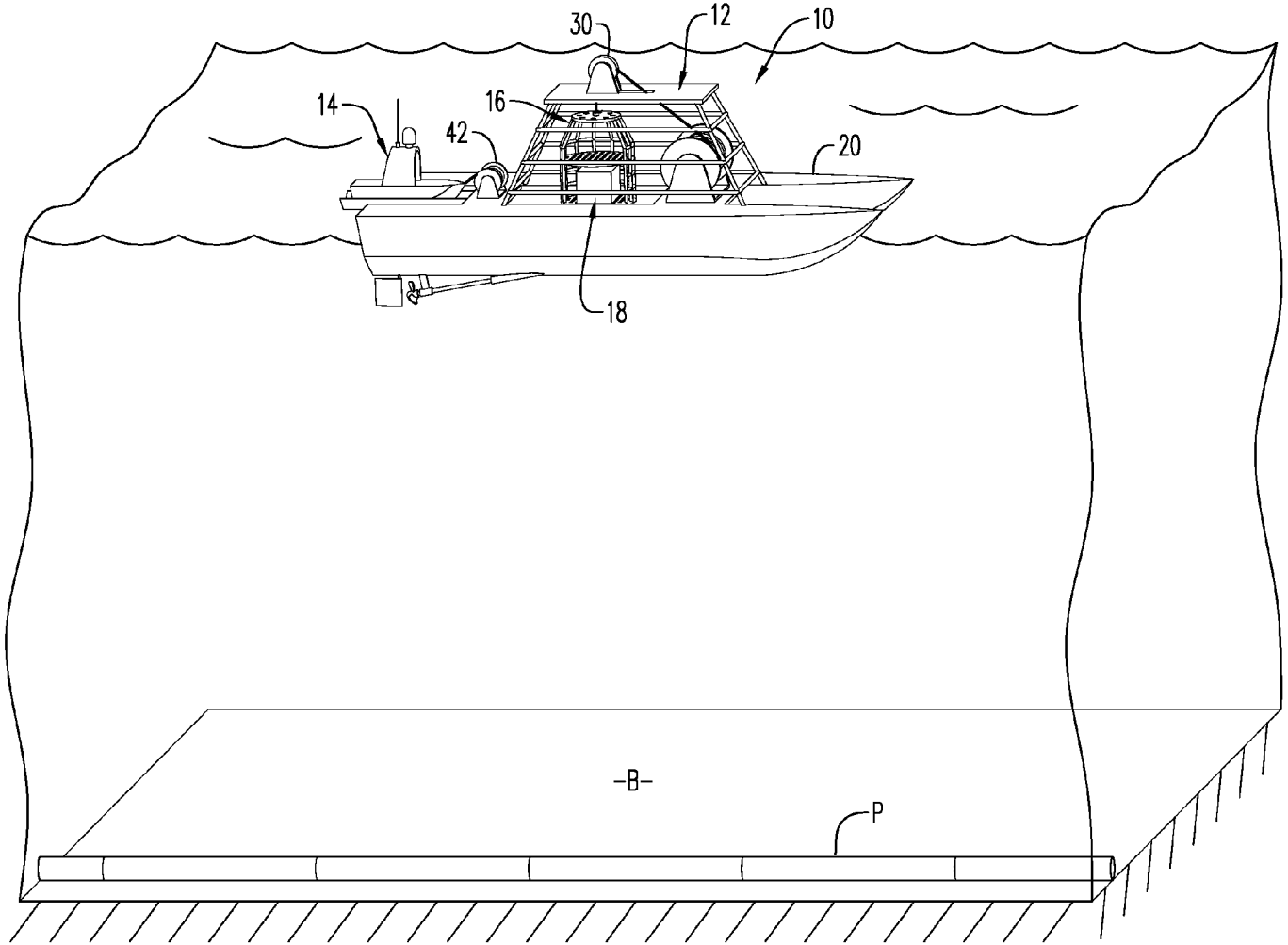
FIG. 8 is a pictorial view of the system traveling at the water surface.
Figure 10:
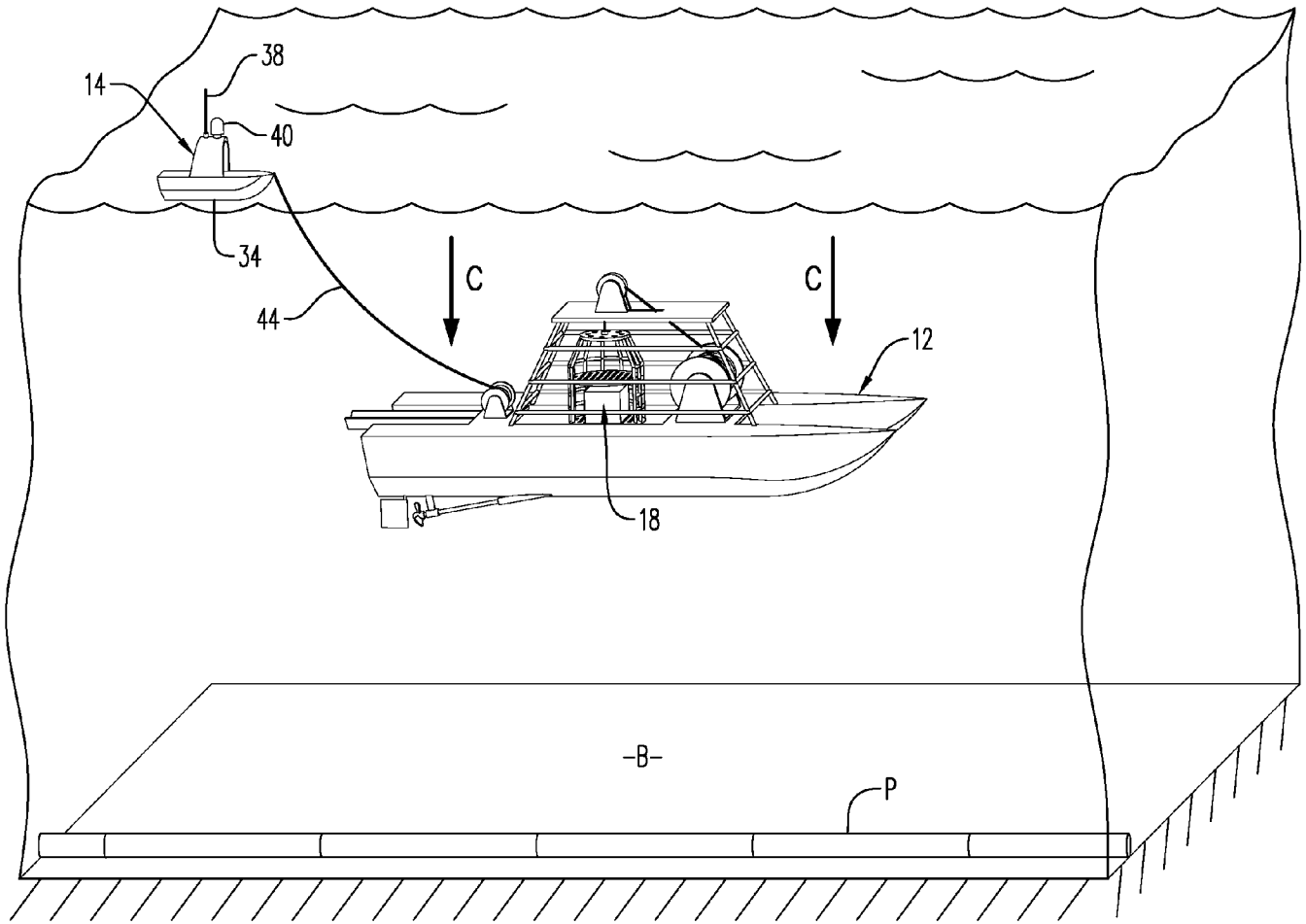

When sea conditions are sufficient to disrupt operations aboard the Sub-Cat 12, ballast and trim equipment within each of the hulls 20 seen in FIG. 7 are utilized to be flooded with water sufficient to render a negative buoyancy condition to the Sub-Cat 12 and the airtight catamaran hulls 20. As seen in FIG. 10, this will cause the Sub-Cat 12 to be lowered in the direction of arrow C beneath the turbulent sea surface. It is envisioned that the submersion of the Sub-Cat 12 will only need to be in the range of 80 to 200 feet of water depth in order to achieve a very stable working condition within the manned catamaran hulls 20 of the Sub-Cat 12. As the Sub-Cat 12 is lowered in the direction of arrow C, the power buoy winch 42 is operated to extend the length of the umbilical cord 44 so that the power buoy 14 remains afloat at the surface of the water.

As previously described, the caged thrusters 32 are operated by battery power within each of the catamaran hulls 20 when the Sub-Cat 12 is submerged. Positioning of the system 10 is then defined by incoming satellite GPS signals received by the GPS antenna 40 which are transmitted into the electronics portion of the Sub-Cat 12 by the umbilical cord 44. Thus, at all times, the positioning of the system 10 is determined by GPS signals into the GPS unit 40 and reestablished and regulated by the responsive energizing of the thrusters 32 to establish and maintain the desired vessel positioning over the work area P on the surface bottom B.

Should radio transmission with other ships or shore based facilities be required, the umbilical cord 44 transmits RF signals back and forth, including those received by the RF antenna 38 and those which are transmitted by the electronics within the catamaran hulls 20 by manned personnel therewithin.

Figure 11:
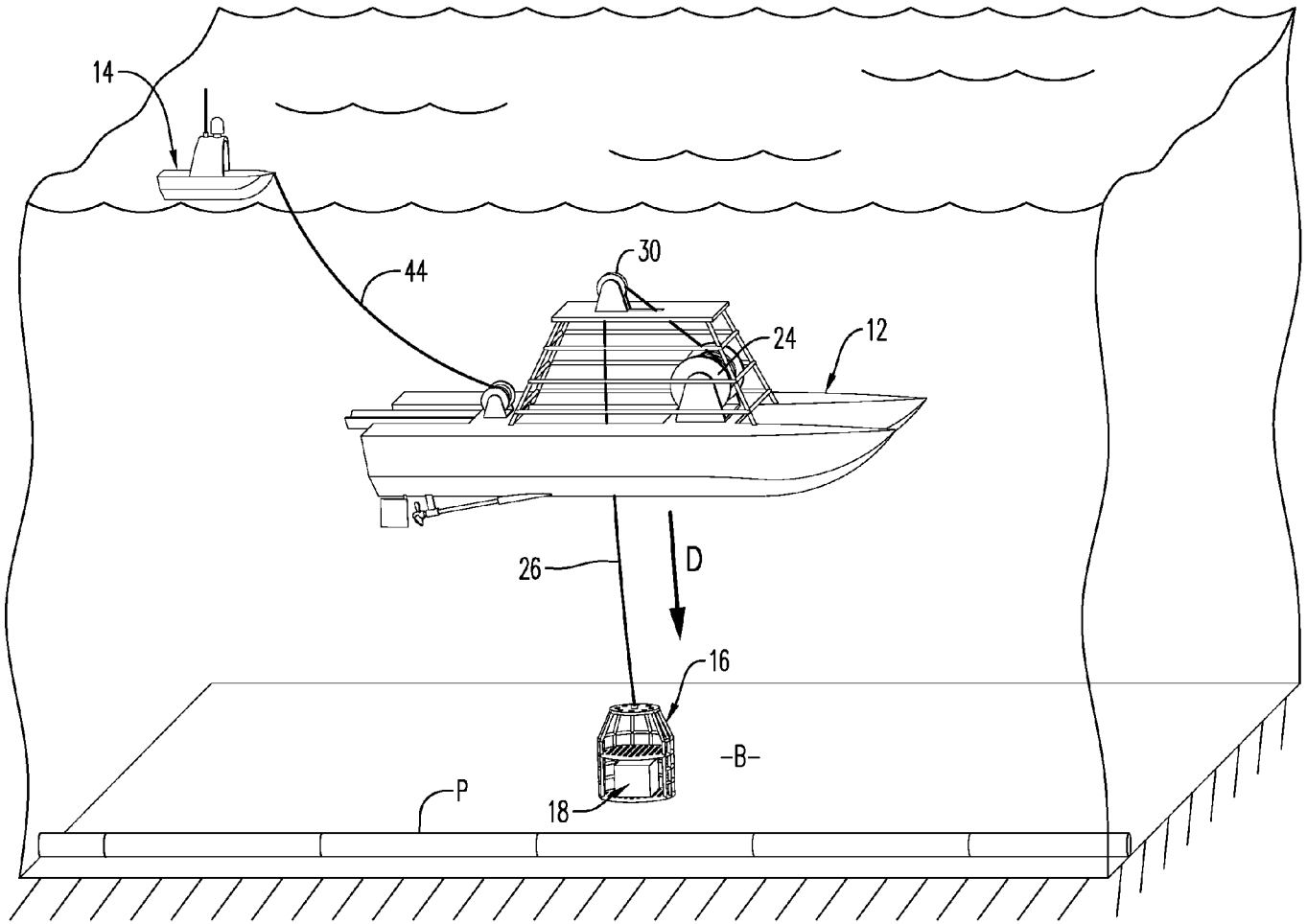
Figure 12:
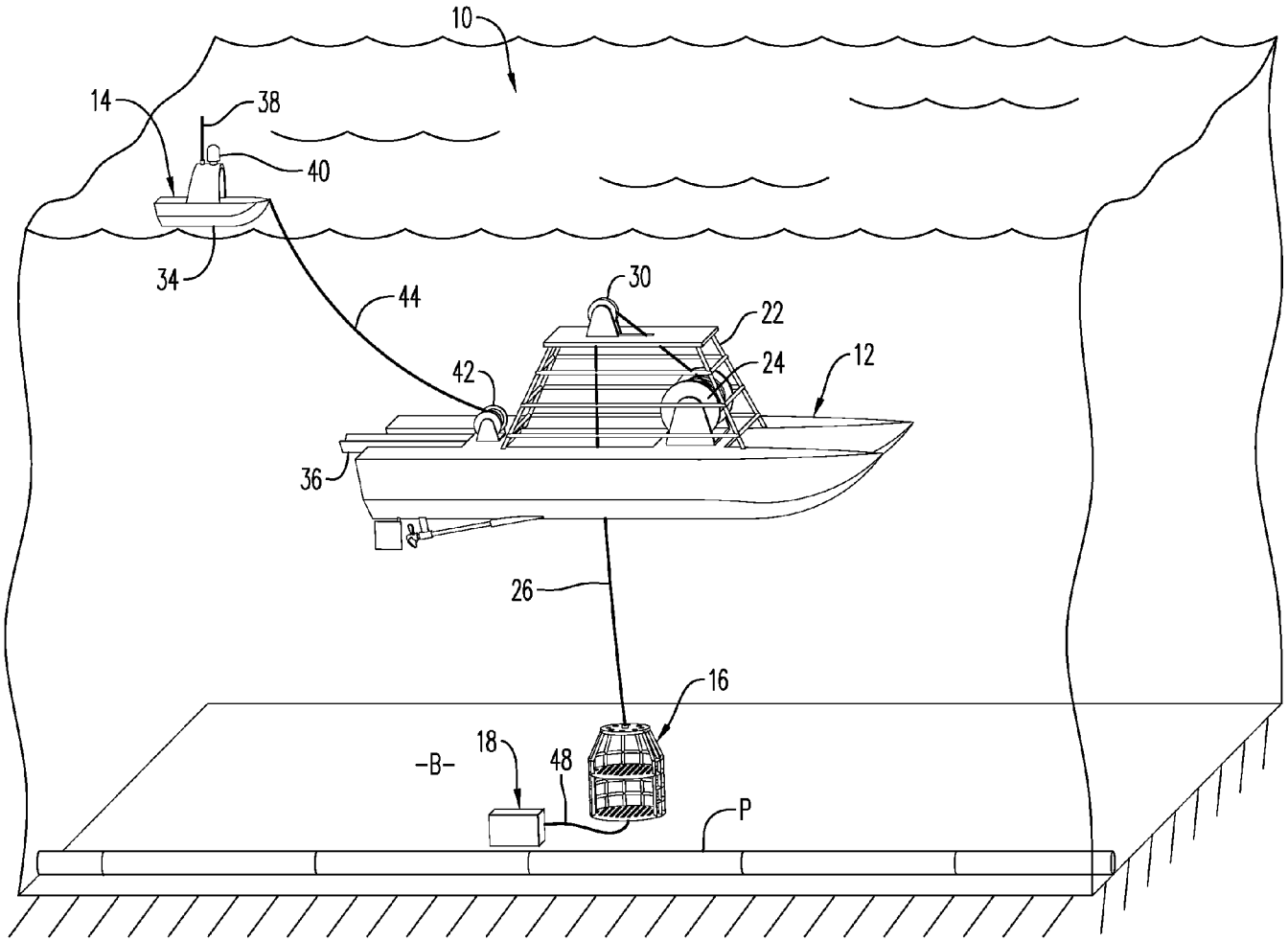

As seen in FIG. 11, the launch cage 16 is then deployed downwardly in the direction of arrow B to be positioned near the sea bottom B. Thereafter, the ROV 18 is deployed from the protective launch cage 16 for conducting necessary installation and repair of the pipeline P as needed. Control signals for the ROV 18 are conveyed through the umbilical cord extension 48 into the ROV umbilical cord 26 and then into the electronics control area within each of the catamaran hulls 20.

The power buoy will typically include storage batteries to maintain the RF and GPS functions above described. However, for extended work periods, when anticipated, the power buoy may also include a small diesel powered generator and accompanying fuel tank to maintain the electrical power necessary for these functions.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A deep water operations system comprising:

a submersible vessel including a propulsion system for operating the vessel both on, and beneath, the surface of a body of water;

the vessel also including buoyancy compensation for selectively positioning the vessel for operation at the surface or submerged beneath the surface to a depth sufficient to avoid surface wave and weather conditions;

a surface power buoy deployable from the vessel at the water surface and connected to the vessel by a first umbilical cord, the power buoy including a propulsion system, radio frequency communication with the vessel, and a global positioning system (GPS) receiver;

the power buoy for receiving GPS position signals and radio frequency signals and transmitting those signals to the vessel and receiving position control and radio frequency transmission signals from the vessel via the first umbilical cord;

a remotely operated vehicle launch cage supported by the vessel by a second umbilical cord, the launch cage storing and deploying a remotely operated vehicle (ROV) within and from beneath the vessel, respectively, the ROV being remotely controlled from the vessel for deep water work and repair activities via the second umbilical cord.

2. A deep water operations system comprising:

a submersible vessel including a first propulsion system for operating the vessel on the surface of a body of water and a second propulsion system for operating the vessel when submerged beneath the water surface;

the vessel also including buoyancy compensation for selectively positioning the vessel for operation at the surface or submerged beneath the surface to a depth sufficient to avoid surface wave and weather conditions;

a surface power buoy deployable from the vessel at the water surface and connected to the vessel by a winch-operated first umbilical cord, the power buoy including a propulsion system for operating the power buoy on the water surface, radio frequency (RF) communication with the vessel, and a global positioning system (GPS) receiver;

the power buoy capable of receiving GPS position signals and RF signals from another boat or ship and for transmitting those signals to the vessel and for receiving position control and RF transmission signals for broadcast from the vessel via the first umbilical cord;

a remotely operated vehicle launch cage supported by the vessel by a winch-operated second umbilical cord, the launch cage storing and deploying a remotely operated vehicle (ROV) within and from beneath the vessel, respectively, the ROV being remotely controlled from the vessel for deep water work and repair activities via the second umbilical cord.

* * * * *